US006883348B2

(12) United States Patent
Hong et al.

(10) Patent No.: US 6,883,348 B2
(45) Date of Patent: Apr. 26, 2005

(54) INDOOR UNIT IN AIR CONDITIONER AND AIR CONDITIONER THEREWITH

(75) Inventors: Ki Su Hong, Anyang-si (KR); Dong Soo Moon, Seoul (KR); Sim Won Chin, Gwangmyeong-si (KR)

(73) Assignee: LG Electronics Inc, Seoul (KR)

( * ) Notice: Subject to any disclaimer, the term of this patent is extended or adjusted under 35 U.S.C. 154(b) by 0 days.

(21) Appl. No.: 10/669,437

(22) Filed: Sep. 25, 2003

(65) Prior Publication Data

US 2004/0089020 A1 May 13, 2004

(30) Foreign Application Priority Data

Nov. 9, 2002 (KR) ..... 10-2002-0069448

(51) Int. Cl.[7] ..... F25B 39/02
(52) U.S. Cl. ..... 62/525; 62/198; 62/504
(58) Field of Search ..... 62/525, 524, 504, 62/519, 151, 152, 155, 198

(56) References Cited

U.S. PATENT DOCUMENTS 5,987,916 A * 11/1999 Egbert ..... 62/498
6,758,053 B2 * 7/2004 Kim et al. ..... 62/198
2004/0050083 A1 * 3/2004 Yuasa et al. ..... 62/222

* cited by examiner

*Primary Examiner*—Marc Norman
(74) *Attorney, Agent, or Firm*—Greenblum & Bernstein, P.L.C.

(57) ABSTRACT

The present invention provides an indoor unit in air conditioner, including two heat exchangers, a connection pipe connecting the heat exchangers, first means for guiding refrigerant flow, and second means provided to the connection pipe. The two heat exchangers, i.e., first and second heat exchangers, have one ends connected to first and second pipelines connected to parts outside of the indoor unit, for an example, a compressor or an outdoor expansion device. The first means selectively guides the refrigerant introduced thereto through the first or second pipeline to be discharged through the second or the first pipeline after being passed through both, or either of the first and second heat exchangers. The second means is provided to the connection pipe so that the refrigerant transferred from one of the first and second heat exchanger to the other one of the first and second heat exchanger is passed in an original state or in an expanded state.

20 Claims, 8 Drawing Sheets

INDOOR UNIT IN AIR CONDITIONER AND AIR CONDITIONER THEREWITH

This application claims the benefit of the Korean Application No. P2002-0069448 filed on Nov. 9, 2002, which is hereby incorporated by reference.

BACKGROUND OF THE INVENTION

1. Field of the Invention

The present invention relates to air conditioners, and more particularly, to an indoor unit in an air conditioner, which has an improved structure that can carry out a function of removal of room moisture while maintaining a constant temperature, and outputs different cooling or heating capacity; and an air conditioner therewith.

2. Background of the Related Art

The air conditioner, for cooling or heating a room, is in general provided with an indoor unit and an outdoor unit. The outdoor unit is provided with a compressor, an outdoor heat exchanger, and a flow control valve, and the indoor unit is provided with an expansion device and an indoor heat exchanger. The air conditioner having the components cools or heats the room depending on a flow direction of the refrigerant, which will be described in more detail.

When the room is cooled, gas refrigerant discharged from the compressor at a high pressure is transferred to the outdoor heat exchanger by control of the flow path control valve, and condensed at the heat exchanger. The liquefied refrigerant is expanded at the expansion device, and vaporized in the indoor heat exchanger. Since the refrigerant absorbs heat from an environment of the indoor heat exchanger as the refrigerant is vaporized, a temperature of air in the environment of the indoor heat exchanger drops. The air of which temperature is dropped thus is discharged to room, and the refrigerant vaporized at the indoor heat exchanger is introduced into the compressor again. Since cold air in the environment of the indoor heat exchanger is discharged into the room continuously if the foregoing process is repeated, the room is cooled.

On the other hand, when the room is heated, the refrigerant discharged from the compressor is introduced into the indoor heat exchanger by the guide of the flow path control valve. Then, the refrigerant heat exchanges with environmental air, and is condensed. The refrigerant discharges condensing heat to the environment as the refrigerant is condensed, and the air heated by the condensing heat is discharged into the room. The refrigerant condensed at the indoor heat exchanger, passes through, and is expanded at the expansion device, and vaporized at the outdoor heat exchanger. The vaporized refrigerant is introduced into the compressor again. Since the air in the environment of the indoor heat exchanger heated by the condensing heat is discharged into the room continuously if the foregoing process is repeated, the room is heated.

However, the foregoing air conditioner always has a fixed cooling or heating capacity because one indoor unit cools or heats a room, which causes a problem in that the air conditioner always outputs an excessive capacity failing to deal with a load required for cooling or heating the room, properly. According to this, problems are caused, in which fine control of the room temperature is impossible, energy is wasted, and maintenance cost is increased.

In the meantime, the related art air conditioner has no other functions other than the cooling or heating, for an example, a function for removing moisture from the room while maintaining a constant temperature, i.e., a fixed temperature dehumidifying function. For reference, the fixed temperature dehumidifying function can be very useful when humidity of a room is high even if the room temperature is suitable for human activity. Consequently, development of an air conditioner is required, which can output a suitable cooling or heating capacity corresponding to variation of a load required for cooling or heating the room, and has the fixed temperature dehumidifying function.

SUMMARY OF THE INVENTION

Accordingly, the present invention is directed to an indoor unit in an air conditioner and an air conditioner therewith that substantially obviates one or more of the problems due to limitations and disadvantages of the related art.

An object of the present invention is to provide an indoor unit in an air conditioner which has a function for removing moisture from a room while maintaining a fixed temperature, and an air conditioner therewith.

Another object of the present invention is to provide an indoor unit in an air conditioner which can output different cooling or heating capacity in correspondence to a size of a load required for cooling or heating the room, and an air conditioner therewith.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the indoor unit in air conditioner includes two heat exchangers, a connection pipe connecting the heat exchangers, first means for guiding refrigerant flow, and second means provided to the connection pipe. The two heat exchangers, i.e., first and second heat exchangers, have one ends connected to first and second pipelines connected to parts outside of the indoor unit, for an example, a compressor or an outdoor expansion device. The first means selectively guides the refrigerant introduced thereto through the first or second pipeline to be discharged through the second or the first pipeline after being passed through both, or either of the first and second heat exchangers. The second means is provided to the connection pipe so that the refrigerant transferred from one of the first and second heat exchanger to the other one of the first and second heat exchanger is passed in an original state or in an expanded state.

In a first preferred embodiment of the present invention, the first means includes a first flow path control valve provided to the connection pipe, a bypass pipe connecting one of ports of the flow path control valve to one point of the second pipeline, and a second flow path control valve provided to the second pipeline at a position between one point of the second pipeline and the second heat exchanger. The flow path control valve is a valve controlled to open or close a flow passage.

The second means includes a third flow path control valve provided to the connection pipe between the first flow path control valve and the second heat exchanger, and a capillary tube connected to the connection pipe parallel to the third flow path control valve. The flow path control valve is a valve controlled to open or close a flow passage.

In a second preferred embodiment of the present invention, the first means includes a first flow path control valve provided to the connection pipe, a bypass pipe connecting one of ports of the flow path control valve and one point of the first tube, and a second flow path control valve provided to a first pipeline at a position between one point of the first pipeline and the first heat exchanger. The flow path control valve is a valve controlled to open or close a flow passage.

The second means includes a third flow path control valve provided to the connection pipe between the first flow path control valve and the second heat exchanger, and a capillary tube connected to the connection pipe parallel to the third flow path control valve. The flow path control valve is a valve controlled to open or close a flow passage.

In the meantime, in another aspect of the present invention, there is provided an air conditioner including an outdoor unit having a compressor, an outdoor heat exchanger, and an outdoor expansion device, which are connected with refrigerant pipe, and an indoor unit having the foregoing structure connected to the outdoor unit. Detailed description of the indoor unit, identical to the foregoing description, will be omitted.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings. In describing embodiments of the present invention, same parts will be given the same names and reference symbols, and repetitive description of which will be omitted. An indoor unit in an air conditioner in accordance with a preferred embodiment of the present invention will be described with reference to FIG. 1.

Figure 1:
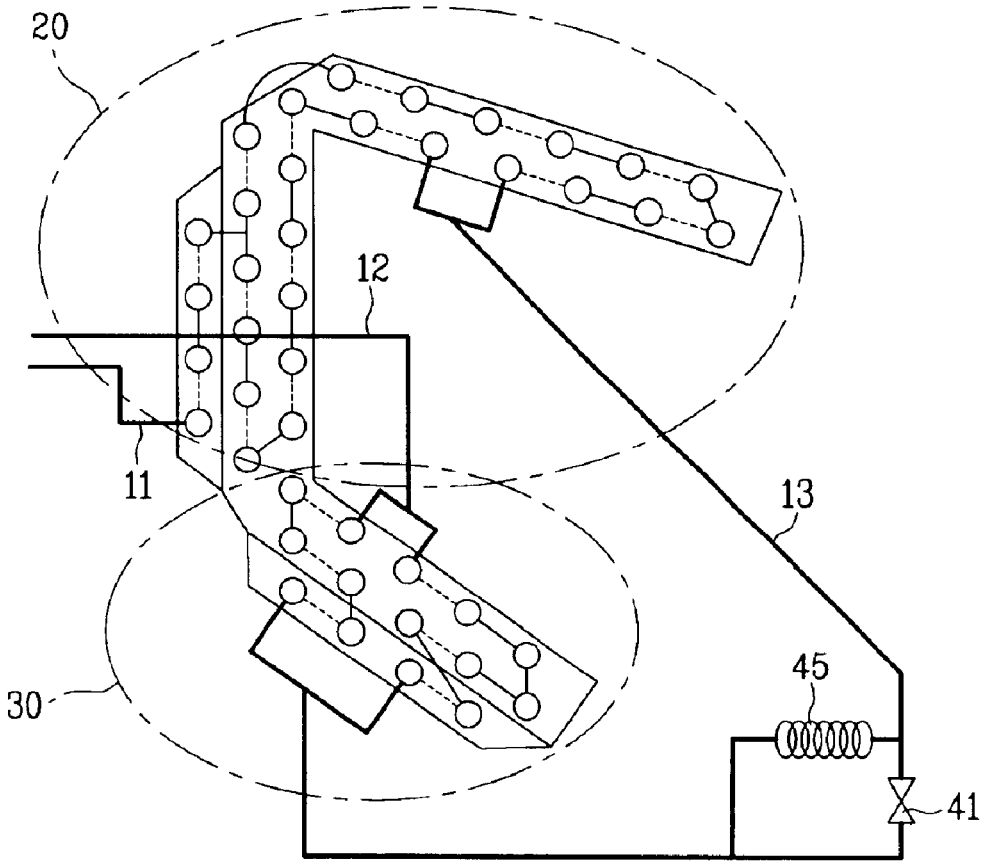
FIG. 1 illustrates a structure of an indoor unit in an air conditioner in accordance with a preferred embodiment of the present invention, schematically.

Referring to FIG. 1, the indoor unit includes first and second heat exchangers 20 and 30, a connection pipe 13, first and second pipelines 11 and 12, and second means for passing refrigerant flowing in the connection pipe 13 as it is, or expanding the refrigerant flowing in the connection pipe 13. The first pipeline 11 is connected an end of the first heat exchanger 20, and the second pipeline 12 is connected to one end of the second heat exchanger 30. The connection pipe 13 connects the other ends of the first heat exchanger 20 and the second heat exchanger 30.

In the meantime, the second means, provided to the connection pipe 13, includes a capillary tube 45, and a third flow path control valve 41. As shown in FIG. 1, the third flow control valve 41 is provided in the middle of the connection pipe 13, and the capillary tube 45 is connected to the connection pipe 13 in parallel to the third flow path control valve 41. The third flow path control valve 41 is a valve for opening or closing a flow passage, for an example, an on/off solenoid valve. In the meantime, the second means is not limited to above system, but the second means may be embodied in a variety of forms. For an example, the second means may be embodied only with an expansion device that has a structure which expands the refrigerant or opens a flow passage of the refrigerant fully.

Though not shown, the indoor unit may be connected to the outdoor unit (not shown) or a distributor (not shown) with the first and second pipelines 11 and 12. The outdoor unit includes a compressor, an outdoor heat exchanger, and an outdoor expansion device. If required, the outdoor unit may further include a flow path control valve (not shown) for fixing a flow direction of refrigerant from the compressor. When the outdoor unit is connected to the first and second pipelines 11 and 12, gas or liquid refrigerant can be introduced into the indoor unit through the first or second pipeline 11 and 12 according to respective operation modes.

In the meantime, when the distributor is connected to the first and second pipelines 11 and 12, the outdoor unit is connected to the distributor. In this case too, the gas or liquid refrigerant can be introduced into the indoor unit through the first or second pipelines 11 and 12. Since the system in which the first and the second pipelines 11 and 12 of the indoor unit are connected to the outdoor unit or the distributor is generally known, the system is not shown, and detailed description of which will also be omitted. However, it is apparent that persons who are skilled in this field of art will understand only with above description.

Operation of the indoor unit for respective operation modes will be described. For reference, the indoor unit has three operation modes, i.e., a first operation mode for cooling the room, a second operation mode for heating the room, and a third operation mode for removing moisture from the room while maintaining a fixed temperature.

In the first operation mode, both the first and second heat exchanger 20 and 30 serve as evaporators. Gas refrigerant from the compressor in the outdoor unit is condensed at the outdoor heat exchanger, expanded at the outdoor expansion device, and introduced into the first heat exchanger 20 through the first pipeline 11. Then, the refrigerant evaporates at the first heat exchanger 20, and absorbs heat from an environment, and cold air in the environment of the first heat exchanger 20 is discharged to the room.

In the meantime, since the third flow path control valve 41 is opened in the first operation mode, the refrigerant evaporated at the first heat exchanger 20 is introduced into the second heat exchanger 30. The refrigerant flows from the first heat exchanger 20 to the second heat exchanger 30, not through the capillary tube 45, but the third flow path control valve 41, due to a flow resistance. That is, since the flow resistance of the capillary tube 45 is very high, the refrigerant flows through the third flow path control valve 41 that has a substantially low flow resistance.

After being evaporated once more and absorbing heat from the environment, the refrigerant introduced into the second heat exchanger 30 is introduced into the outdoor unit through the second pipeline 12. In this instance, cold air in the environment of the second heat exchanger 30 is discharged into the room. In the first operation mode, the air conditioner, repeating the foregoing process, cools the room.

Next, in the second operation mode, both the first and second heat exchangers 20 and 30 serve as condensers. The refrigerant discharged from the compressor in the outdoor unit is introduced into the second heat exchanger 30 through the second pipeline 12. The refrigerant discharges heat to the environment and is condensed at the second heat exchanger 30. The air heated by the condensing heat from the second heat exchanger 30 is discharged into room.

In the meantime, since the third flow control valve 41 is opened in the second operation mode, the refrigerant discharged from the second heat exchanger 30 is introduced into the first heat exchanger 20 as it is. In this instance, the refrigerant does not pass through the capillary tube 45 under the same reason described before. Refrigerant not condensed at the second heat exchanger 30 yet is condensed at the first heat exchanger 20, to discharge condensing heat, the air in the environment of the first heat exchanger 20 heated by the condensing heat is discharged to the room.

The refrigerant condensed at the first heat exchanger 20 is introduced into the outdoor unit, expanded at the outdoor expansion device, evaporated at the outdoor heat exchanger, and introduced into the compressor. In the second operation mode, above process is repeated for heating the room.

In the meantime, in the third operation mode, the first heat exchanger 20 serves as a condenser, and the second heat exchanger 30 serves as an evaporator. The refrigerant discharged from the compressor in the outdoor unit is condensed at the outdoor heat exchanger. Since the outdoor expansion device is opened in the third operation mode, the refrigerant is introduced into the first heat exchanger 20 through the first pipeline 11 in a condensed state. In the first heat exchanger 20, the refrigerant is condensed once more, and discharges condensing heat.

In the third operation mode, since the third flow path control valve 41 is closed, the refrigerant from the first heat exchanger 20 passes through, and is expanded at the capillary tube 45, introduced into, and vaporized at the second heat exchanger 30, to absorb heat from an environment of the second heat exchanger 30. The refrigerant passed through the second heat exchanger 30 is introduced into the compressor in the outdoor unit through the second pipeline 12.

In the meantime, in the foregoing operation, as moisture is condensed at the surface of the second heat exchanger 30, there is condensed water formed at the surface of the second heat exchanger 30 which serves as an evaporator. Since the condensed water formed thus is discharged to outside of the room, humidity of the room drops. Moreover, since the air heated by the condensing heat generated at the first heat exchanger 20 and the air cooled down by the vaporizing heat absorbed at the second heat exchanger 30 are discharged into the room together, the room is maintained at a fixed temperature.

However, the air conditioner that cools or heats the room by the foregoing process, or makes a fixed temperature dehumidification has the following problem. Because both of the first and second heat exchangers 20 and 30 are operated regardless of load required for cooling or heating the room, proper dealing with different required load has not been possible. That is, since both the first and second heat exchangers 20 and 30 are operated even if a low cooling or heating load is required, fine temperature control of the room is difficult and there is waste of energy more than required.

Accordingly, the present invention suggests an improved indoor unit and air conditioner that can solve the foregoing problems. The improved indoor unit of the present invention may be embodied in two embodiments. Each of the embodiments of the improved indoor unit of the present invention includes two heat exchangers, i.e., first and second heat exchangers, first, and second pipelines connected to an outdoor unit or a distributor, and a connection pipe connecting the two heat exchangers, second means provided to the connection pipe, and first means for guiding a flow path of the refrigerant proper to respective operation modes.

In the indoor unit of improved structure of the present invention, structures of the first and second heat exchangers, the first and second pipelines, the connection pipe, the second means are the same with the indoor unit described with reference to FIG. 1. Therefore, while omitting description of the parts described with reference to FIG. 1 already, only description of the first means will be made, that embodies different embodiments depending on positions thereof. In the meantime, in describing the embodiments, parts identical to the parts of the indoor unit described with reference to FIG. 1 will be given the same names and reference symbols.

First embodiment of the indoor unit of the improved structure will be described with reference to FIG. 2. For reference, FIG. 2 illustrates a structure of an improved indoor unit in an air conditioner in accordance with a first preferred embodiment of the present invention, schematically.

Figure 2:
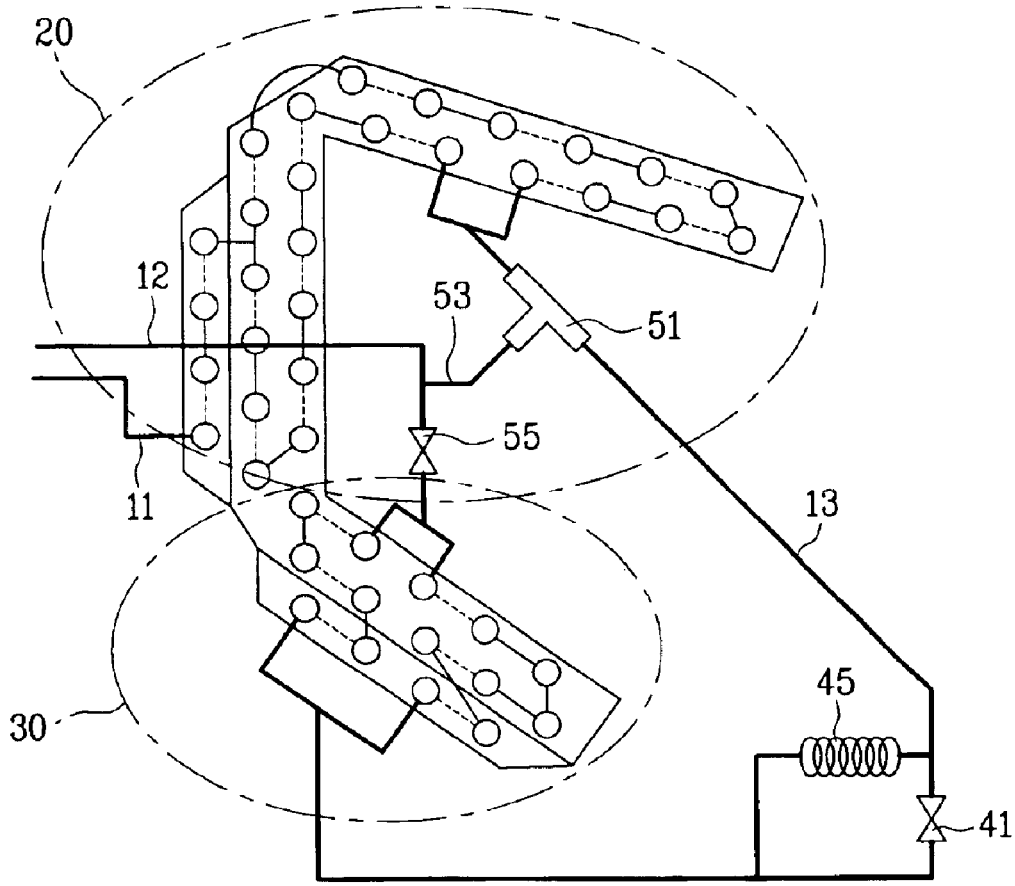
FIG. 2 illustrates a structure of an improved indoor unit in an air conditioner in accordance with a first preferred embodiment of the present invention, schematically.

Referring to FIG. 2, in the first embodiment improved indoor unit, the first means includes a first flow path control valve 51, a bypass pipe 53, and a second flow path control valve 55. The first means selectively guides a refrigerant flow so that the refrigerant introduced through the first or second pipeline 11 or 12 passes both the first and second heat exchangers 20 and 30, or either of the first and second heat exchangers 20 and 30, and is discharged to an exterior, for an example, the outdoor unit or the distributor through the second or first tube 11 or 12.

Referring to FIG. 2, in the first embodiment, the first flow control valve 51 is provided to a point of the connection pipe 13. In more detail, the first flow path control valve 51 is provided to a point of the connection pipe 13 positioned between the second means including the capillary tube 45 and the third flow path control valve 41 and the first heat exchanger 20. The first flow path control valve 51 has three ports, wherein the first port is in communication with the first heat exchanger 20, the second port is in communication with the second means, and the third port is connected to the bypass pipe 53. The first flow path control valve having the foregoing structure is controlled such that the first and second ports are made to be in communication, or the first port and the third port are made in communication according to respective operation modes.

The bypass pipe 53 has one end connected to the third port of the first flow path control valve 51, and the other end is in communication with a point of the second pipeline 12. The second flow path control valve 55 is provided to the second pipeline 12, in more detail, between one point where the bypass pipe 53 is connected thereto and an end where the second heat exchanger 30 is connected thereto. The second flow path control valve 55 is a valve that opens or closes a flow passage, for an example, an on/off solenoid valve.

Figure 3A:
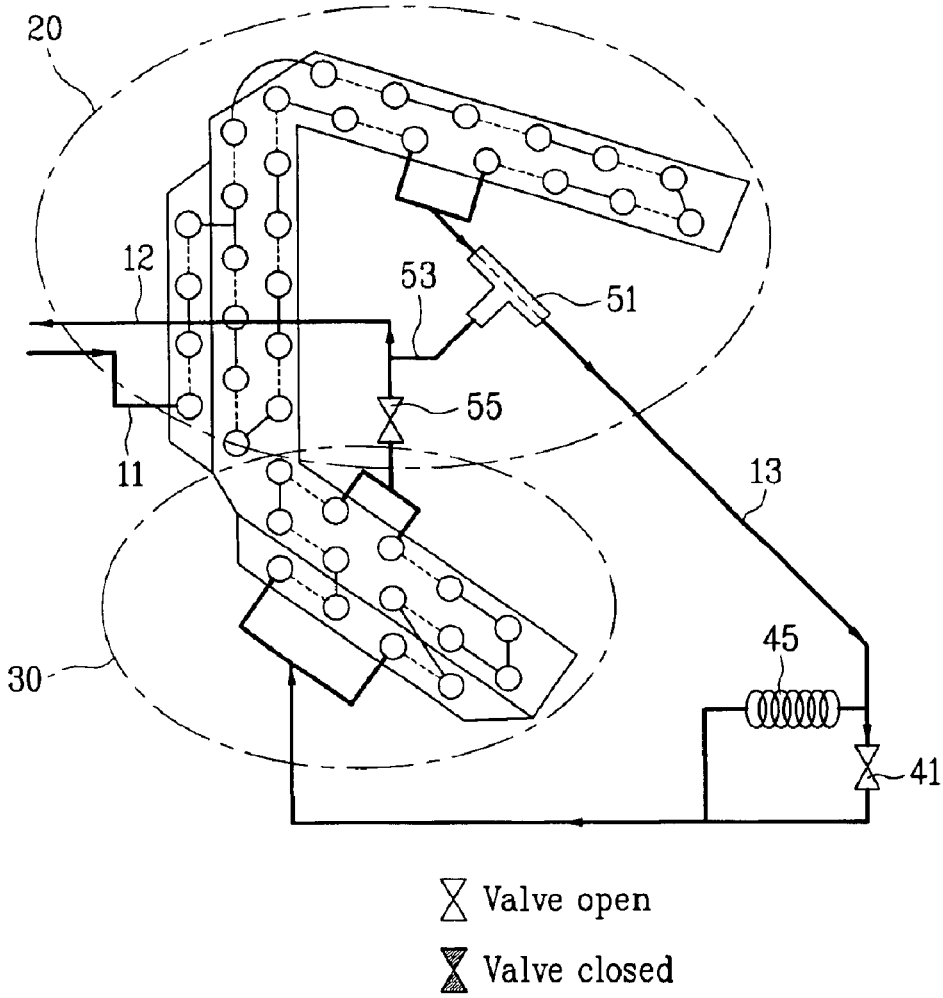
FIG. 3A illustrates an operation of the indoor unit in an air conditioner in FIG. 2 in cooling a room at a regular load.
Figure 3B:
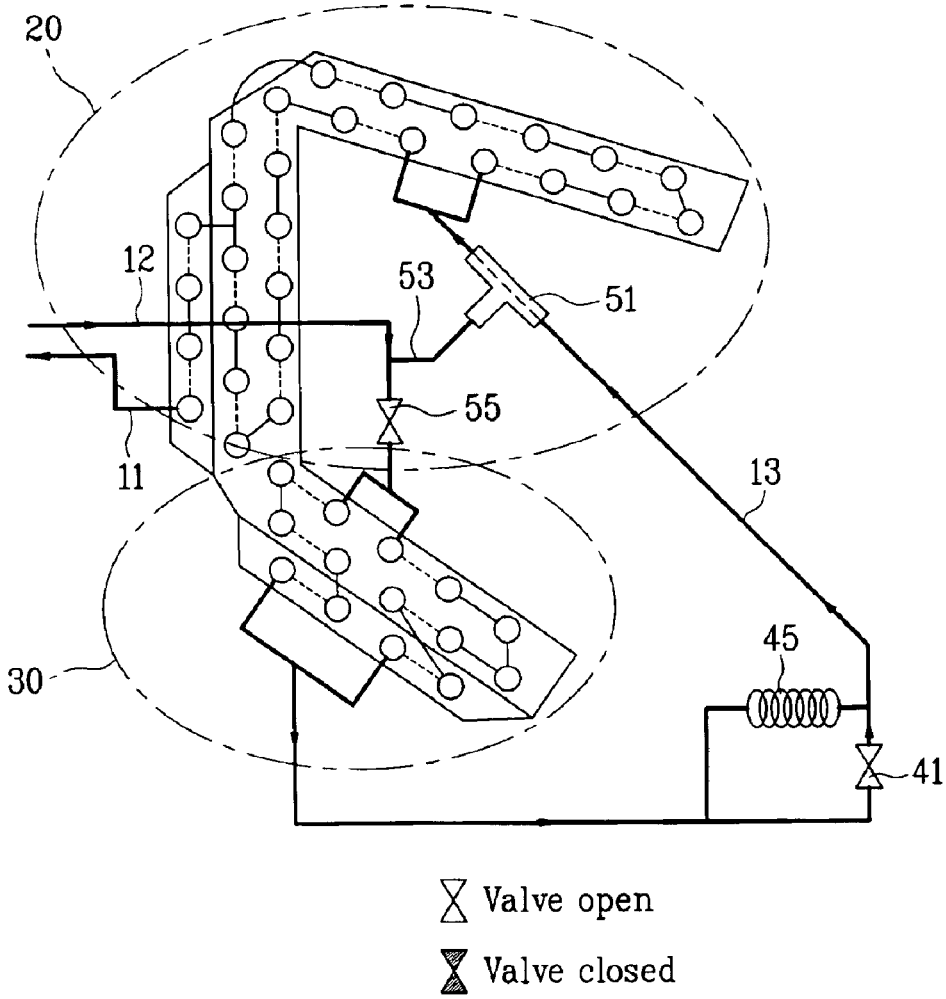
FIG. 3B illustrates an operation of the indoor unit in an air conditioner in FIG. 2 in heating a room at a regular load.
Figure 4A:
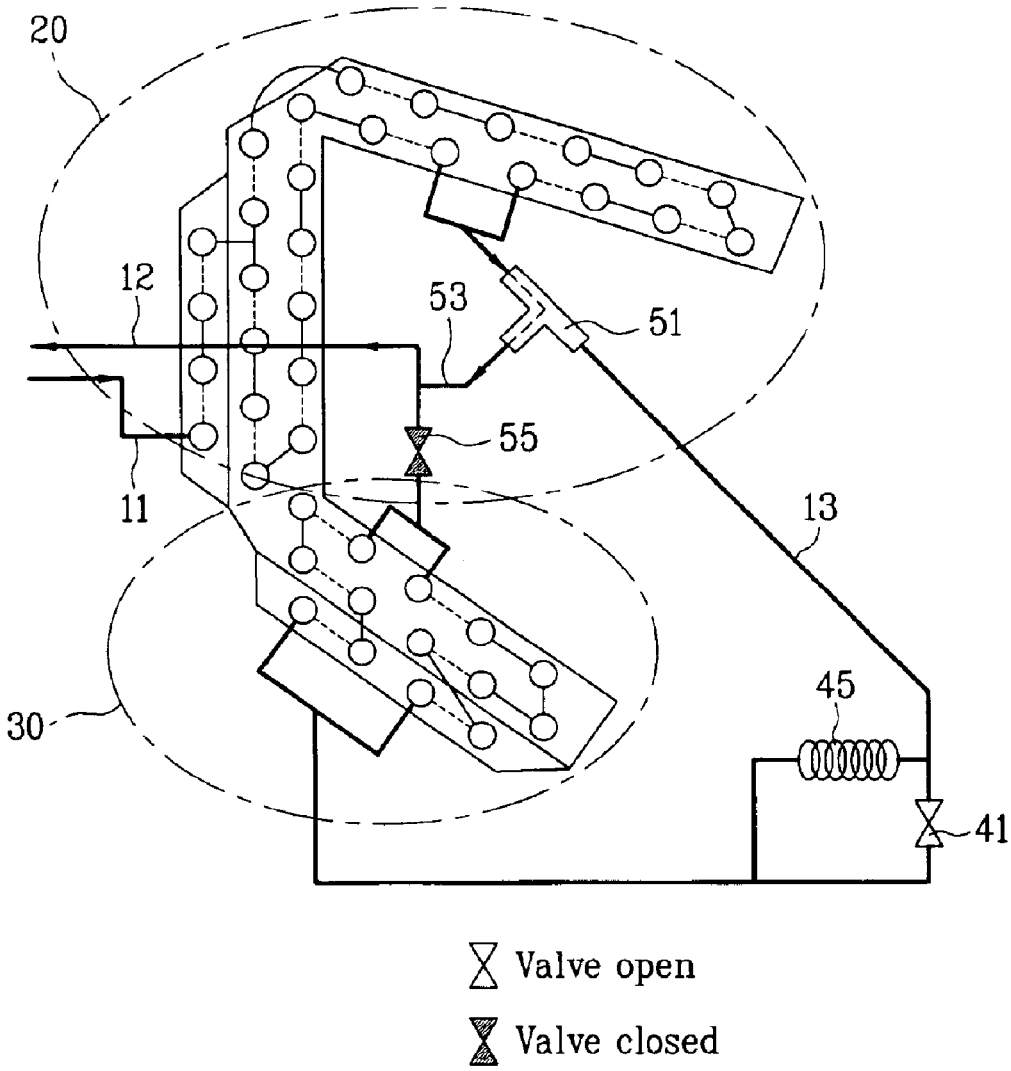
FIG. 4A illustrates an operation of the indoor unit in an air conditioner in FIG. 2 in cooling a room at a low load.
Figure 4B:
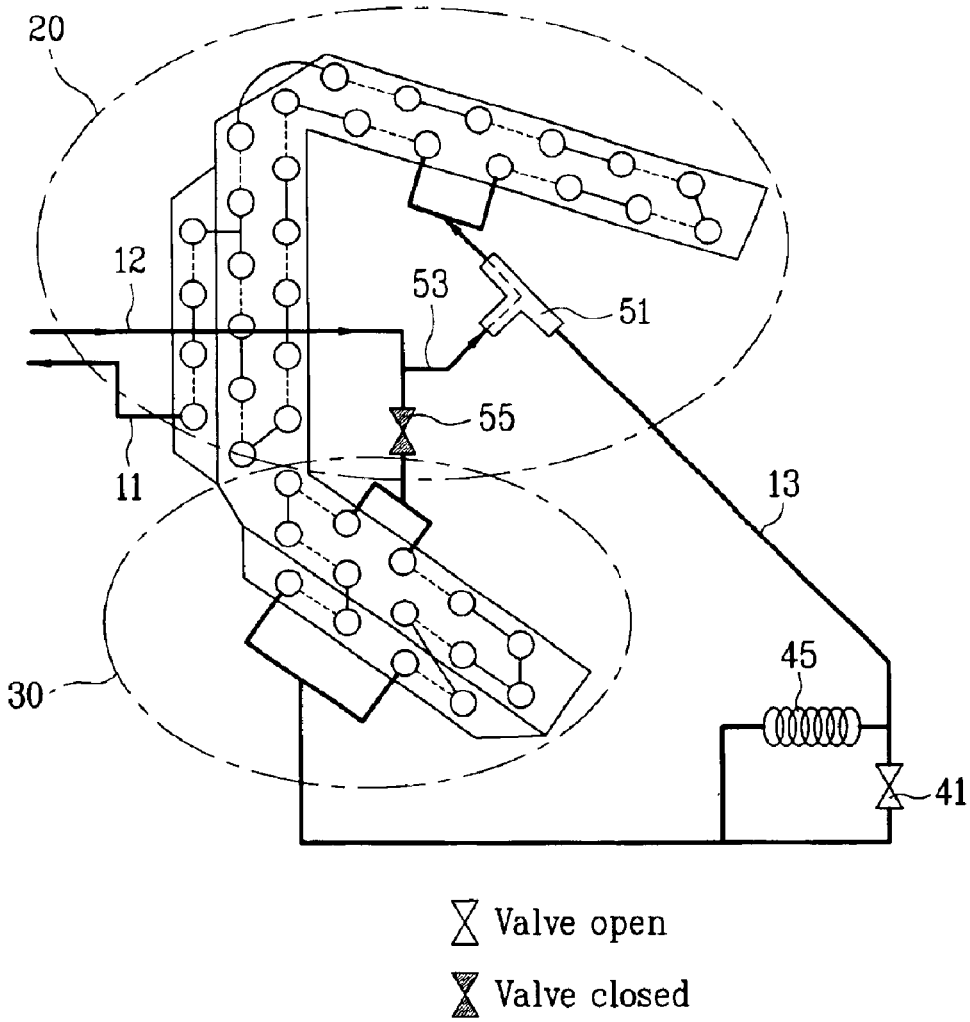
FIG. 4B illustrates an operation of the indoor unit in an air conditioner in FIG. 2 in heating a room at a low load.
Figure 5:
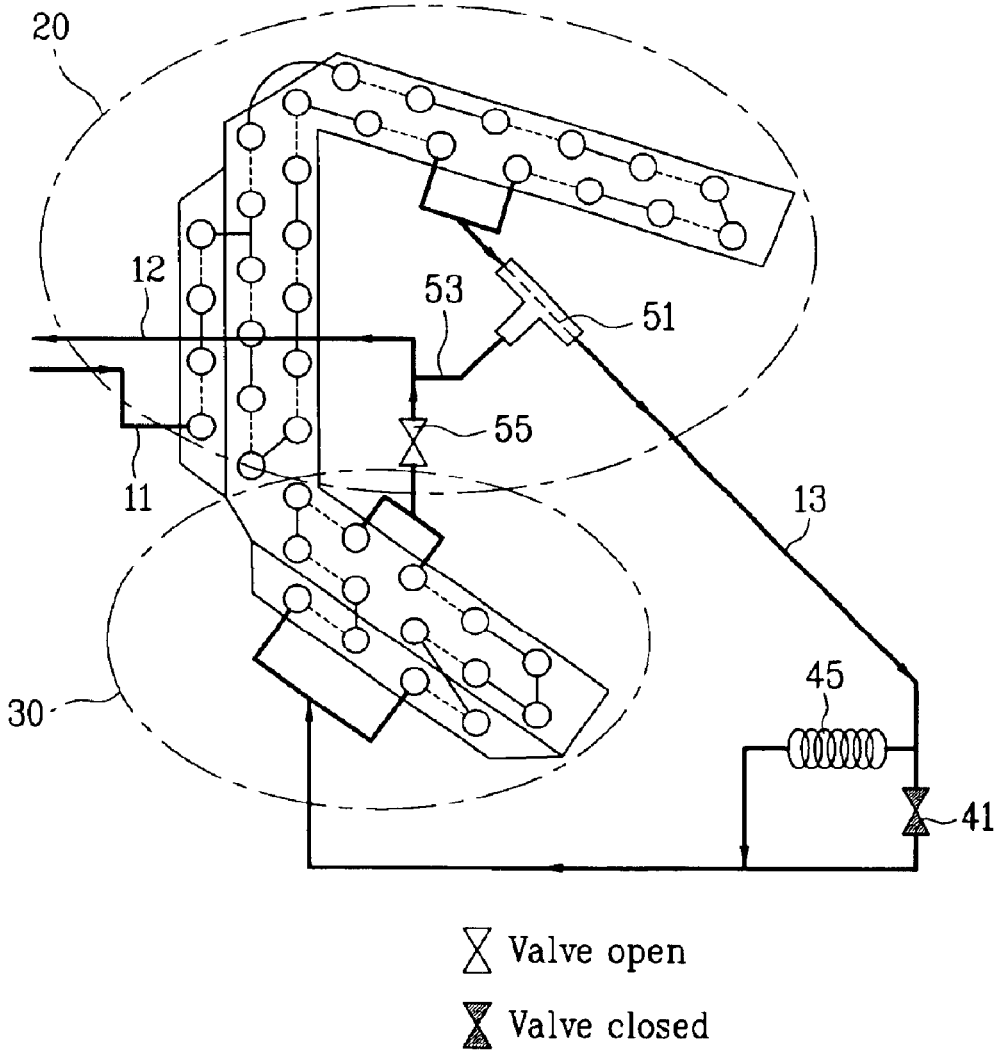
FIG. 5 illustrates an operation of the indoor unit in an air conditioner in FIG. 2 in carrying out a fixed temperature dehumidifying function.

The operation of the foregoing indoor unit will be described for respective operation modes in detail, with reference to FIGS. 3A~5. For reference, the indoor unit is operated in five operation modes, i.e., a first operation mode for cooling the room at a regular load, a second operation mode for heating the room at a regular load, a third operation mode for cooling the room at a low load, a fourth operation mode for heating the room at a low load, and a fifth operation mode for controlling a humidity of the room while maintaining a fixed temperature. FIG. 3A illustrates an operation of the indoor unit in an air conditioner in FIG. 2 in cooling a room at a regular load, FIG. 3B illustrates an operation of the indoor unit in an air conditioner in FIG. 2 in heating a room at a regular load. FIG. 4A illustrates an operation of the indoor unit in an air conditioner in FIG. 2 in cooling a room at a low load, FIG. 4B illustrates an operation of the indoor unit in an air conditioner in FIG. 2 in heating a room a low load, and FIG. 5 illustrates an operation of the indoor unit in an air conditioner in FIG. 2 in carrying out a fixed temperature dehumidifying function.

The operation in the first operation mode will be described with reference to FIG. 3A. For reference, in the first operation mode, both the first and second heat exchangers 20 and 30 serve as evaporators. The refrigerant discharged from the compressor in the outdoor unit is condensed at the outdoor heat exchanger, and expanded at the outdoor expansion device. The expanded refrigerant is introduced into the first heat exchanger 20 through the first pipeline 11, and vaporizes at the first heat exchanger 20 and absorbs heat from an environment, and the cooled down air in the environment of the first heat exchanger 20 is discharged to the room.

Referring to FIG. 3A, in the first operation mode, the first flow path control valve 51 in the first means is controlled to make the first port and the second port in communication. Therefore, the refrigerant discharged from the first heat exchanger 20 is introduced into the second heat exchanger 30 through the opened third flow path control valve 41. The reason the refrigerant does not pass the capillary tube 45 is the same with the reason described with reference to FIG. 1, of which description will be omitted.

In the second heat exchanger 30, the refrigerant not vaporized at the first heat exchanger 20 yet is vaporized to absorb heat from an environment, again. Also, the cold air in the environment of the second heat exchanger 30 is discharged to the room. The refrigerant passed through the second heat exchanger 30 is discharged to the second tube 12. In this instance, since the second flow path control valve 55 is opened, and the third flow path control valve 41 is controlled such that the first port and the second port are in communication, the refrigerant is transferred to the outdoor unit or the distributor through the second tube 12. In the first operation mode, the room is cooled at a regular load in which both of the heat exchangers are in operation while repeating the foregoing process.

The second operation mode will be described with reference to FIG. 3B. For reference, in the second operation mode, both of the first and second heat exchangers 20 and 30 serve as condensers. The refrigerant discharged from the compressor in the outdoor unit is introduced into the second pipeline 12. As shown in FIG. 3B, in the second operation mode, since the first flow path control valve 51 is controlled to make the first and second ports be in communication, and the third flow path control valve 41 is controlled to open the flow passage, the refrigerant introduced into the second pipeline 12 is introduced into the second heat exchanger 30.

The refrigerant introduced into the second heat exchanger 30 is condensed and discharges condensing heat to an environment, and the air heated by the condensing heat is discharged to the room. The refrigerant condensed at the second heat exchanger 30 passes through the opened third flow path control valve 41, and introduced into the first heat exchanger 20 through the first flow path control valve 51. Condensing heat is discharged from the first heat exchanger 20 as the refrigerant not condensed at the second heat exchanger 30 yet is condensed at the first heat exchanger 20, and the air in an environment of the first heat exchanger 20 heated by the condensing heat is discharged into the room.

The refrigerant passed through the first heat exchanger 20 is transferred to the distributor or the outdoor unit through the first pipeline 11, expanded at the outdoor expansion device in the outdoor unit, vaporized at the outdoor heat exchanger, and introduced into the compressor. In the second operation mode, the room is heated in a regular load in which both of the heat exchangers are operated while the foregoing process is repeated.

In the meantime, in the third or fourth operation mode, the room is either cooled or heated with a low load. First, the third operation mode will be described, in which the room is cooled at a low load, with reference to FIG. 4A. For reference, in the third operation mode, only the first heat exchanger 20 is operated to serve as an evaporator, and the second heat exchanger 30 is not operated.

The refrigerant discharged from the compressor in the outdoor unit is condensed at the outdoor heat exchanger, and expanded at the outdoor expansion device. The expanded refrigerant is introduced into the first heat exchanger 20 through the first pipeline 11. The refrigerant is vaporized at the first heat exchanger 20, absorbs heat from an environment, and the cooled down air in the environment of the first heat exchanger 20 is discharged into the room.

Referring to FIG. 4A, in the third operation mode, the first flow path control valve 51 in the first means is controlled to make the first port and the third port in communication. According to this, the refrigerant discharged from the first heat exchanger 20 is introduced into the second pipeline 12 through the bypass pipe 53. In the third operation mode, the second flow path control valve 55 is closed as shown in FIG. 4A. Therefore, the refrigerant introduced into the second pipeline 12 is transferred to the distributor or the outdoor unit, entirely. The refrigerant transferred to the outdoor unit is introduced into the compressor.

Next, the fourth operation mode will be described with reference to FIG. 4B. For reference, in the fourth operation mode, only the first heat exchanger 20 is operated to serve as a condenser, and the second heat exchanger 30 is not operated. The refrigerator discharged from the compressor in the outdoor unit is introduced into the second pipeline 12. As shown in FIG. 4B, in the fourth operation mode, since the second flow path control valve 55 is closed, and the first flow path controlled valve 51 is operated to make the first port and the third port in communication, the refrigerant is introduced into the first heat exchanger 20 through the bypass pipe 53 and the connection pipe 13.

The refrigerant discharges the condensing heat to an environment and condensed at the first heat exchanger 20, and the air heated by the condensing heat is discharged to the room. The condensed refrigerant is introduced into the outdoor unit or the distributor through the first pipeline 11, expanded at the outdoor expansion device, vaporized at the outdoor heat exchanger, and introduced into the compressor.

In the third or fourth operation mode operated thus, since only the first heat exchanger 20 is operated, a heat exchange area is small and an amount of cooling or heating output is also small. Therefore, the third or fourth operation mode can deal with a case where a load required for cooling or heating the room is very small, effectively. According to this, fine control of the room temperature is possible, and unnecessary waste of energy can be prevented, effectively. Moreover, the second heat exchanger 30 is not operated unnecessarily, and air conditioning efficiency is improved.

In the meantime, though not shown, and not described in detail, for more effective progress of the third or fourth operation mode, it is preferable that a frequency of the compressor, a rotation speed of the indoor unit or outdoor unit fan, and openings of the expansion devices are adjusted.

Next, the fifth operation mode in which moisture is removed from the room while maintaining a fixed temperature will be described with reference to FIG. 5. For reference, in the fifth operation mode, the first heat exchanger 20 serves as a condenser, and the second heat exchanger 30 serves as an evaporator. The refrigerator discharged from the compressor in the outdoor unit is condensed at the outdoor heat exchanger, passes through the opened outdoor expansion device, and introduced into the first heat exchanger 20 through the first pipeline 11.

At the first heat exchanger 20, the refrigerant not condensed at the outdoor heat exchanger but is condensed to discharge a condensing heat. In the fifth operation mode, since the first flow path control valve 51 is controlled to make the first port and the second port be in communication, as shown in FIG. 5, the refrigerant condensed at the first heat exchanger 20 is transferred to the second means. Moreover, in the fifth operation mode, since the third flow path control valve 41 is closed, the refrigerant transferred to the second means is passed through, and expanded at the capillary tube 45 in the second means, and introduced into the second heat exchanger 30.

At the second heat exchanger 30, the refrigerant absorbs heat form an environment, and vaporized, and the cooled down air in the environment of the second heat exchanger 30 is discharged to the room. The vaporized refrigerant is introduced into the outdoor unit or the distributor through the second pipeline 12, and introduced into the compressor, finally. In this instance, as shown in FIG. 5, the second flow control valve 55 maintains an opened state.

When the foregoing process is carried out, condensed water is formed as moisture is condensed at a surface of the first heat exchanger 20. The condensed water is discharged to an exterior by a discharging device (not shown). Therefore, the moisture is removed from the room continuously during the fifth operation mode is carried out, humidity of the room is dropped. Since the hot air in the environment of the first heat exchanger 20 and the cold air in the environment of the second heat exchanger 30 are discharged together into the room, the room can be maintained at a fixed temperature.

Figure 6:
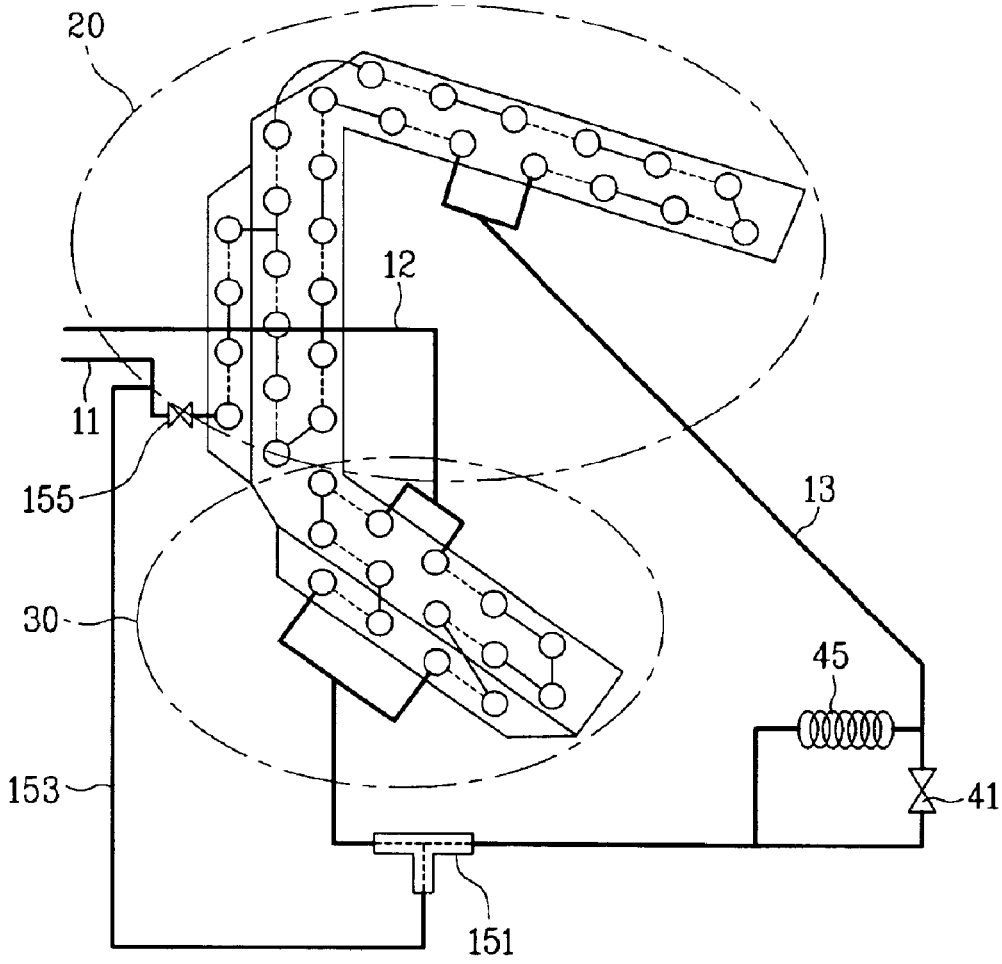
FIG. 6 illustrates a structure of an improved indoor unit in an air conditioner in accordance with a first preferred embodiment of the present invention, schematically.

An improved indoor unit in accordance with a second preferred embodiment of the present invention will be described with reference to FIG. 6. For reference, FIG. 6 illustrates a structure of an improved indoor unit in an air conditioner in accordance with a first preferred embodiment of the present invention, schematically. Since the second embodiment has all parts identical to the parts described with reference to FIGS. 1 and 2 except the first means, description of which will be omitted, and the first means will be described.

Referring to FIG. 6, the first means in the second embodiment includes a first flow path control valve 151, a bypass pipe 153, and second flow path control valve 155. Though elements of the first means are identical to the elements of the first means in the first embodiment described with reference to FIGS. 2~5, relations of joining are different slightly, which will be described.

Referring to FIG. 6, the first flow path control valve 151 is provided to the connection pipe 13 between the second heat exchanger 30 and the second means. One end of the bypass pipe 153 is connected to the third port of the first flow path control valve 151, and the other end of the bypass pipe 153 is connected to one point of the first pipeline 11 as shown in FIG. 6. The second flow path control valve 155 is provided to the first pipeline 11 at a position between one point where the bypass pipe 153 is connected thereto and an end where the first heat exchanger 20 is connected thereto.

The foregoing indoor unit in accordance with the second preferred embodiment of the present invention also has the same operation principle and effect as the first embodiment except that, when the load is low, while the first heat exchanger 20 is operated in the first embodiment, the second heat exchanger 30 is operated in the second embodiment. Moreover, in the fifth operation mode, while the first heat exchanger 20 serves as a condenser and the second heat exchanger 30 serves as an evaporator in the first embodiment, the first heat exchanger 20 serves as an evaporator and the second heat exchanger 30 serves as a condenser in the second embodiment.

As has been described, the indoor unit in an air conditioner of the present invention has the following advantages.

First, the two indoor heat exchangers controlled in different ways can remove moisture from the room while maintaining a fixed room temperature.

Second, cooling or heat capacity can be varied with required room cooling or heating load. According to this, since fine room temperature control is available, room can always be maintained at an optimal environment.

Third, since only one of the two heat exchangers in the indoor unit can be put into operation, unnecessary waste of energy can be prevented, effectively.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An indoor unit in an air conditioner, comprising:

a first heat exchanger having a first end and a second end, the first end connecting to a first pipe;

a second heat exchanger having a first end and a second end, the first end connecting to a second pipe; and a first guide that receives the refrigerant from one of the first and second heat exchangers, and that selectively guides the refrigerant to the other of the first and second heat exchangers in a first mode and that selectively guides the refrigerant to bypass the other of the first and second heat exchangers in a second mode;

wherein the refrigerant that is received by the other of the first and second heat exchangers in the first mode is received in one of an original state and an expanded state.

2. The indoor unit as claimed in claim 1, further comprising a connection pipe that connects the second end of the first heat exchanger and the second end of the second heat exchanger; and the first guide comprising:

a first flow path control valve provided to the connection pipe, a bypass pipe connecting a port of the first flow path control valve to the second pipe, and a second flow path control valve provided to the second pipe between the second heat exchanger and the connection point of the bypass pipe.

3. The indoor unit as claimed in claim 2, wherein the second flow path control valve is controlled to selectively open and close a flow path to the second heat exchanger.

4. The indoor unit as claimed in claim 2, further comprising:

a third flow path control valve provided to the connection pipe between the first flow path control valve and the second heat exchanger, and a capillary tube connected to the connection pipe in parallel to the third flow path control valve.

5. The indoor unit as claimed in claim 4, wherein the third flow path control valve is controlled to selectively open and close a flow passage to the second heat exchanger.

6. The indoor unit as claimed in claim 1, further comprising:

a connection pipe that connects the second end of the first heat exchanger and the second end of the second heat exchanger; and the first guide comprising:

a first flow path control valve provided to the connection pipe, a bypass pipe connecting a port of the first flow path control valve to the first pipe, and a second flow path control valve provided to the first pipe between the first heat exchanger and the connection point of the bypass pipe.

7. The indoor unit as claimed in claim 6, wherein the second flow path control valve is controlled to selectively open and close a flow passage to the first heat exchanger.

8. The indoor unit as claimed in claim 6, further comprising:

a third flow path control valve provided to the connection pipe between the first flow path control valve and the first heat exchanger, and a capillary tube connected to the connection pipe in parallel to the third flow path control valve.

9. The indoor unit as claimed in claim 8, wherein the third flow path control valve is controlled to selectively open and close a flow passage to the first heat exchanger.

10. The indoor unit as claimed in claim 1, further comprising:

a third flow path control valve provided to the connection pipe between the first flow path control valve and the first heat exchanger, and a capillary tube connected to the connection pipe in parallel to the third flow path control valve.

11. An air conditioner, comprising:

an outdoor unit that includes a compressor, an outdoor heat exchanger, and an outdoor expansion device connected with a refrigerant pipe; and an indoor unit comprising:

a first heat exchanger having a first end and a second end, the first end connecting to a first pipe that is connected to the outdoor unit;

a second heat exchanger having a first end and a second end, the first end connected to a second pipe that is connected to the outdoor unit, and a first guide that receives the refrigerant from one of the first and second heat exchangers, and that selectively guides the refrigerant to the other of the first and second heat exchangers in a first mode and that selectively guides the refrigerant to bypass the other of the first and second heat exchangers in a second mode, wherein the refrigerant that is received by the other of the first and second heat exchangers in the first mode is received in one of an original state and an expanded state.

12. The indoor unit as claimed in claim 11, the indoor unit further comprising:

a connection pipe that connects the second end of the first heat exchanger and the second end of the second heat exchanger; and the first guide comprising:

a first flow path control valve provided to the connection pipe, a bypass pipe connecting a port of the first flow path control valve to the second pipe, and a second flow path control valve provided to the second pipe between the second heat exchanger and the connection point of the bypass pipe.

13. The indoor unit as claimed in claim 12, wherein the second flow path control valve is controlled to open and close a flow passage to the second heat exchanger.

14. The indoor unit as claimed in claim 12, further comprising:

a third flow path control valve provided to the connection pipe between the first flow path control valve and the second heat exchanger, and a capillary tube connected to the connection pipe in parallel to the third flow path control valve.

15. The indoor unit as claimed in claim 14, wherein the third flow path control valve is controlled to open and close a flow passage to the second heat exchanger.

16. The indoor unit as claimed in claim 11, the indoor unit further comprising:

a connection pipe that connects the second end of the first heat exchanger and the second end of the second heat exchanger; and the first guide comprising:

a first flow path control valve provided to the connection pipe, a bypass pipe connecting a port of the first flow path control valve to a point on the first pipe, and a second flow path control valve provided to the first pipe at a position between the first heat exchanger and the connection point of the bypass pipe.

17. The indoor unit as claimed in claim 16, wherein the second flow path control valve is controlled to open and close a flow passage to the first heat exchanger.

18. The indoor unit as claimed in claim 16, further comprising:

a third flow path control valve provided to the connection pipe between the first flow path control valve and the first heat exchanger, and a capillary tube connected to the connection pipe parallel to the third flow path control valve.

19. The indoor unit as claimed in claim 18, wherein the third flow path control valve is controlled to open and close a flow passage to the first heat exchanger.

20. The indoor unit as claimed in claim 11, further comprising:

a third flow path control valve provided to the connection pipe between the first flow path control valve and the first heat exchanger, and a capillary tube connected to the connection pipe in parallel to the third flow path control valve.

* * * * *